United States Patent [19]

Brown et al.

[11] Patent Number: 4,857,025

[45] Date of Patent: Aug. 15, 1989

[54] TOWABLE MODIFIED DEEP VEE SURFBOARD

[76] Inventors: James H. Brown, 274 Palmier St., Costa Mesa, Calif. 92626; Richard N. Ricca, 4627 Fairfield Dr., Corona Del Mar, Calif. 92625

[21] Appl. No.: 85,845

[22] Filed: Aug. 17, 1987

[51] Int. Cl.[4] ..... A63C 15/00

[52] U.S. Cl. ..... 441/65; 441/74; 441/79

[58] Field of Search ..... 114/253, 246, 270; 441/65, 72, 74, 79

[56] References Cited

U.S. PATENT DOCUMENTS

| | | | |
|---|---|---|---|
| D. 145,083 | 6/1946 | Howland . | |
| 2,389,729 | 11/1945 | Howland . | |
| 3,064,286 | 11/1962 | Hammond . | |
| 3,145,399 | 8/1964 | Jackson . | |
| 3,284,823 | 11/1966 | Steffel | 441/79 |
| 3,380,090 | 4/1968 | Kenmuir | 114/253 |
| 3,422,786 | 1/1969 | Brandhorst . | |
| 3,543,315 | 12/1970 | Hoffman | 441/74 |
| 3,600,733 | 8/1971 | Lippisch . | |
| 3,626,428 | 12/1971 | Collaro . | |
| 3,666,281 | 5/1972 | Billings . | |
| 3,698,342 | 10/1972 | Jackson . | |
| 3,761,980 | 10/1973 | Silverstein . | |
| 3,777,325 | 12/1973 | Bristol | 441/65 |
| 3,921,239 | 11/1975 | Sovia et al. | 441/65 |
| 4,020,782 | 5/1977 | Gleason | 114/270 |
| 4,302,858 | 12/1981 | Casciano | 441/65 |
| 4,538,540 | 9/1985 | Cashmere . | |
| 4,608,023 | 8/1986 | Williams . | |
| 4,629,435 | 12/1986 | Pitcairn . | |
| 4,652,245 | 3/1987 | May . | |
| 4,669,992 | 6/1987 | Morris | 441/65 |
| 4,710,143 | 12/1987 | Boulanger | 441/65 |

*Primary Examiner*—Sherman D. Basinger
*Assistant Examiner*—Thomas J. Brahan
*Attorney, Agent, or Firm*—Fulwider, Patton, Rieber, Lee & Utecht

[57] ABSTRACT

A towable surfboard including a hull formed in its fore portion with a bow having on its underside a modified deep-vee configuration and extending rearwardly to form on its underside of its aft section a flatter bottom configuration. A seat is mounted about ¾ of the way back on the deck and heel cups are mounted forwardly thereof such that a rider may sit on the seat with his heels received in such cups and grasp a tow rope to be towed behind a power boat.

22 Claims, 3 Drawing Sheets

TOWABLE MODIFIED DEEP VEE SURFBOARD

BACKGROUND OF THE INVENTION

1. Field of the Invention

The present invention relates generally to water sports, and more particularly to a towable rough water surfboard adapted for carrying a rider sitting on the board and grasping a rope to be towed behind a motorboat or the like.

2. Description of the Prior Art

Water skiing is a popular water sport but is so physically demanding that many people are unable to participate for extended periods of time. Also, there are certain characteristics of water skiing and surfing which are enjoyed by many. The benefits of combining these characteristics into one sport are appreciated. Efforts along this line have led to the development of wind surfers which provide a water vessel which enables the user to experience some of the features of the combined sports of sailing and surfing. Other developments have led to self propelled water ski devices along the order of a motorcycle ridden on water.

Attempts have also been made to reduce the physical demands placed on a water skier by, for example, combining a chair or the like with a surfboard to provide a device somewhat resembling a surfboard upon which a person ca sit while being towed over the water; one such device is disclosed in U.S. Pat. No. 3,626,428 issued to Collaro on Dec. 7, 1971.

Towable surfboards such as the one disclosed by Collaro are subject to being towed through relatively calm water at fairly high speeds. This board is formed with a relatively flat bottom which provides for satisfactory performance in calm water unaffected by surface waves and swells. It is difficult, especially in rough water, for a rider to turn or otherwise maneuver such a surfboard at high speed without falling off. The flat bottom provides for poor performance in rough water and the chair tends to hold the rider in a relatively erect sitting position which detracts from the ability to control the board and causes his back to be subjected to substantial direct axial shock forces in the event of operation at high speeds in rough water.

SUMMARY OF THE INVENTION

The present invention provides a towable surfboard adapted for carrying a rider in a sitting position and modified deep vee bottom for accommodating waves and swells encountered at high speeds. The board and rider are towed through the water by a tow rope extending from a motorboat or the like and held by the rider. A surfboard according to the invention can be turned and maneuvered through rough water at high speed safely and without upset.

Briefly and in general terms, a towable surfboard according to the invention comprises a surfboard hull having sufficient buoyancy to support a rider on a body of water. The surfboard mounts a seat rearwardly on its deck and has an undersurface formed of laterally disposed longitudinally extending running areas inclined downwardly and inwardly from outboard extremities toward a center keel defining a ski and cooperating together to form a modified deep-vee bottom extending from the bow and flattening out somewhat toward the stem aft of the vessel to form a somewhat rounded riding surface. Such keel is formed in its aft portion with a downwardly opening control groove.

The surfboard has an upper surface or deck including a seating area adapted to support the rider in a sitting position and a footrest area forward of the seating area and adapted to support the rider's feet.

In a preferred embodiment retaining means such as a lap belt retains the rider in the seating area and means such as toeguards mounted adjacent the footrest area retain the rider's feet in the footrest area.

The seating area is defined, for example, by a concavity in the upper surface of the board or by an upwardly projecting raised area in the upper surface of the board. A cushion may be included in the seating are for greater comfort.

The footrest area is defined, for example, by a concavity in the upper surface of the board. In a preferred embodiment, the footrest area comprises left and right heel cups each defined by a concavity in the upper surface of the board and each adapted to support one of the rider's feet. These concavities define elongated, flattened foot rest surfaces inclined inwardly and downwardly from outboard extremities of the upper surface of the surfboard member for supporting the rider's feet such that the rider's feet can be braced against the foot rest surfaces when the rider and board are being towed. For additional comfort the concavities project rearwardly toward each other to accommodate the rider's feet in a toes-pointing-outwardly disposition.

In one embodiment the undersurface of the board curves upwardly and outwardly from the running areas to then turn downwardly forming laterally disposed tunnels which serve to catch and direct air and water passing from such running areas during high speed operation to thus tend to stabilize the craft while deflecting water spray outwardly and downwardly away from the face of a rider riding on the deck thereof.

Other aspects and advantages of the present invention will become apparent from the following detailed description, taken in conjunction with the accompanying drawings, illustrating by way of example the principles of the invention.

DESCRIPTION OF THE PREFERRED EMBODIMENT

Figure 1:
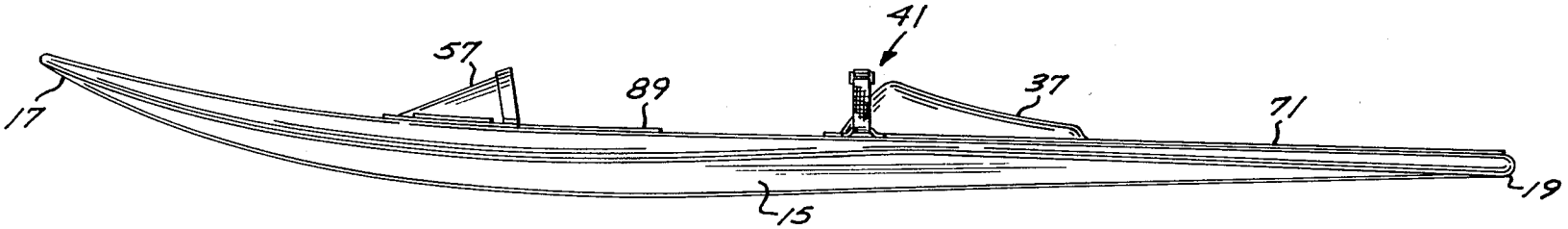
FIG. 1 is a side elevational view of a towable surfboard embodying the novel features of the present invention.

As shown in the drawings for purposes of illustration, the invention is embodied in a towable surfboard for carrying a rider sitting on the board and holding a tow rope which is pulled by a motorboat or the like. Towable surfboards ar subject to being towed through rough water at high speeds, and there is a need for a stable, maneuverable board which can be towed under such conditions and which can be turned as desired without being subject to upset. Any such surfboards formed without a modified deep-vee hull suffer the shortcoming that they are not practical for use on relatively rough ocean waters or on inland lakes where there is an substantial degree of surface waves or swells.

In accordance with the invention, a towable surfboard includes a hull formed on its bottom side with a centrally disposed flat keel extending along its undersurface from its bow toward its stern, the keel becoming concave in cross section near the stern to form a groove which facilitates turning and provides stability. Seating and footrest areas are provided on the upper surface to accommodate the rider, and downwardly opening channels are formed on the underside at the outboard extremities to catch air and water passing thereunder to stabilize the vessel while shielding the rider from spray. A surfboard according to the invention can be towed and maneuvered at high speeds through rough water safely and without upset.

Turning now to the drawings, a towable surfboard comprises a surfboard hull, generally designated 11, having sufficient buoyancy to support a rider on a body of water. The hull 11 has an upper deck surface 13 adapted for carrying the rider and an undersurface 15 for contacting the water, one end of the member defining a bow 17 and an opposite extremity defining a stern 19.

The hull may be laid up of fiberglass and may have a length for a 150 pound adult, for example, of about eight feet, width of about two feet at its widest point and tapering inwardly and rearwardly from the opposite sides to a width of about eight inches just before its rounded stern. I have discovered that lengths of from six and one half to ten feet accommodate the greater percentage of likely participants. The shape in plan view simulates a conventional surfboard and the underside of the forward section is in the form of a modified deep-vee hull and the underside of the rear portion in the form of a flat-vee hull.

Referring to FIGS. 3 and 7–11, the undersurface 15 is formed of oppositely disposed longitudinally extending running areas 21 and 23 inclined downwardly and inwardly from the opposite outboard extremities 25 and 27 of the undersurface 15 toward a center and joining together at the center to form a flattened keel defining a ski 29 having a width of about 3 inches and projecting rearwardly from the bow 17 toward the stern 19.

The lateral running surfaces are formed on their respective fore portions, 22 and 24 respectively, to angle upwardly and outwardly from the ski 29, at an angle of about 20 degrees from the horizontal. It is important that this fore portion be formed with the running surfaces projecting at an angle of no less than about 15 degrees to the horizontal to thus afford the consequent cutting function as the upwardly angled hull planes through the water and waves at high speeds.

Figure 4:
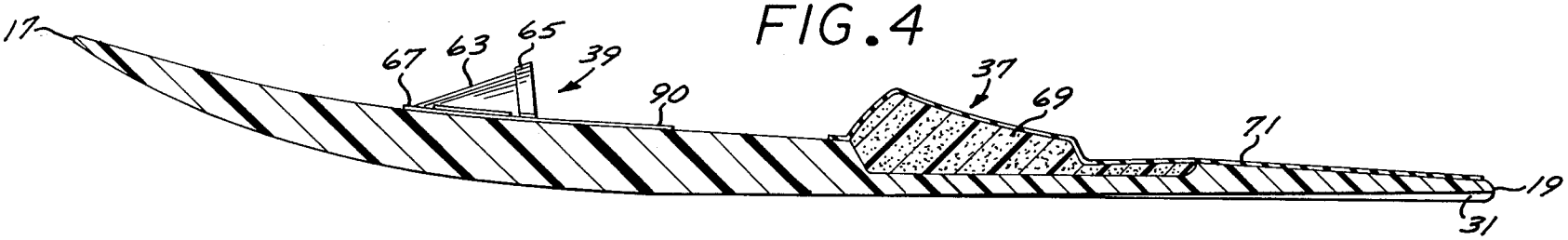
FIG. 4 is a longitudinal sectional view, taken along the line 4—4 of FIG. 2.
Figure 6:
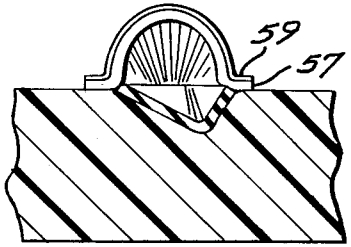
FIG. 6 is a vertical sectional view, taken along the line 6—6 of FIG. 5.
Figure 5:
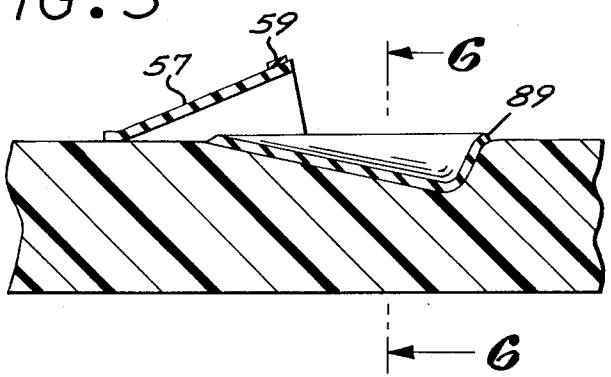
FIG. 5 is a fragmentary sectional view, in enlarged scale, taken along the line 5—5 of FIG. 2.

Referring to the longitudinal sectional view shown in FIG. 4, the fore portion turns upwardly and forwardly from a point amidship to define the upwardly raked bow to facilitate water entry at high speeds.

Figure 7:
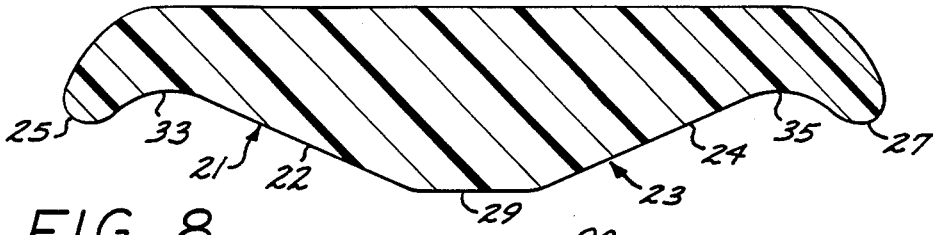
FIG. 7 is a transectional view, in enlarged scale, taken along the line 7—7 of FIG. 2.
Figure 8:
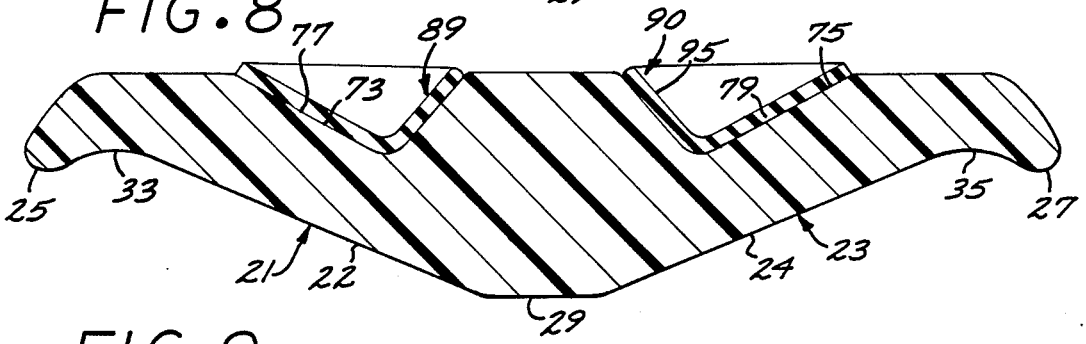
FIG. 8 is a transectional view, in enlarged scale, taken along the line 8—8 of FIG. 2.
Figure 9:
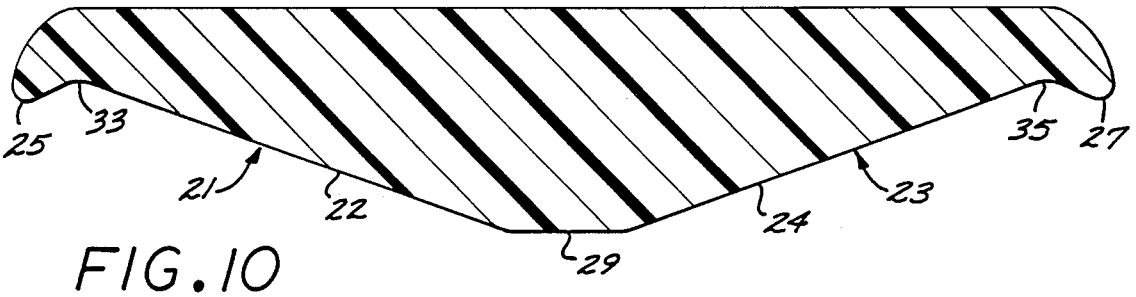
FIG. 9 is a transectional view, in enlarged scale, taken along the line 9—9 of FIG. 2.
Figure 10:
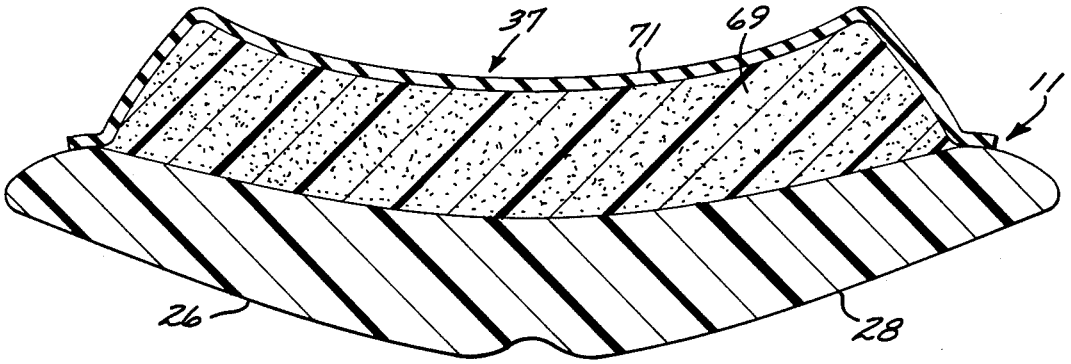
FIG. 10 is a transectional view, in enlarged scale, taken along the line 10—10 of FIG. 2.

As viewed in FIGS. 7, 8 and 9, the fore portions 22 and 24 project rearwardly at about the same angle from the horizontal over the distance from the bow to about 75% of the overall lengths. At a point just aft of the weight carrying point the running areas 21 and 23 transition to rounded riding surfaces 26 and 28 which are somewhat convex in transverse section to angle upwardly and outwardly from the center at a angle of about 11 degrees to the horizontal to thus form flatter running surfaces. It is believed that this angle should be no less than about 5 degrees to the horizontal and no greater than about 15 degrees to afford the necessary riding surface configuration to afford the desired performance during turns at high speed in rough water.

Referring to FIGS. 7, 8 and 9, the hull is formed in its fore portion to project outboard beyond the respective running portions 22 and 24 to thus turn downwardly to form respective downwardly opening longitudinal tunnels 33 and 35 and to then turn further downwardly and outwardly to form spray rails at the respective outboard edges 25 and 27.

The ski 29 is planar in the fore portion and at about 75% of the distance to the stern 19 is turned upwardly centrally to define a downwardly opening control groove 31. The groove gradually widens as it extends rearwardly under the aft 25% of the vessel to open rearwardly at the stern.

Figure 11:
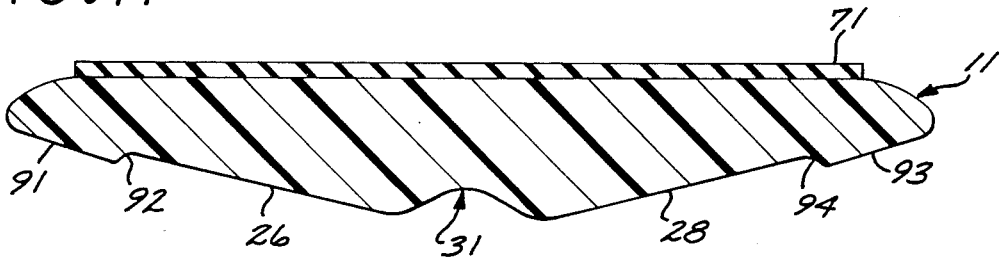
FIG. 11 is a transectional view, in enlarged scale, taken along the line 11—11 of FIG. 2.

Referring to FIG. 11, the hull at the outboard extremities of the running surfaces 26 and 28 over the aft 25% of the vessel is formed with respective left and right stabilizer wings defining respective bearing surfaces 91 and 93 spaced below the planes of the respective downwardly facing running surfaces 26 and 28. Formed at the inboarad edges of such bearing surfaces are respective control ledges 92 and 94.

The upper deck surface 13 of the hull includes a seating area 37 disposed about 65% of the overall length aft of the stern and is adapted to support the rider in a rearwardly inclined sitting position. Referring to FIG. 4, footrest area 39 forward of the seating area 37 and adapted to support the rider's feet whereby with his feet supported on the foot area will have his back conformed to a generally rearwardly inclined position.

In a preferred embodiment the seating area 37 is defined by a concavity in the upper surface of the board. A cushion 69 of foam rubber or the like is disposed in the concavity for the comfort of the rider and is covered by a waterproof plastic cover having its periphery affixed to the surface of the board and projecting rearwardly from the seat area to form an apron covering the aft portion of the deck. The seat cushion is formed with an upwardly and forwardly projecting upper surface. This raised area may be defined by the cushion 69, as illustrated, or by the board itself.

In the preferred embodiment, an elastic lap belt 41 has its opposite ends connected to the surfboard on opposing sides of the seating area 37 and is arranged to cross closely over the rider's lap to retain the rider in the seating area 37 and the board generally captive to the rider.

Figure 2:
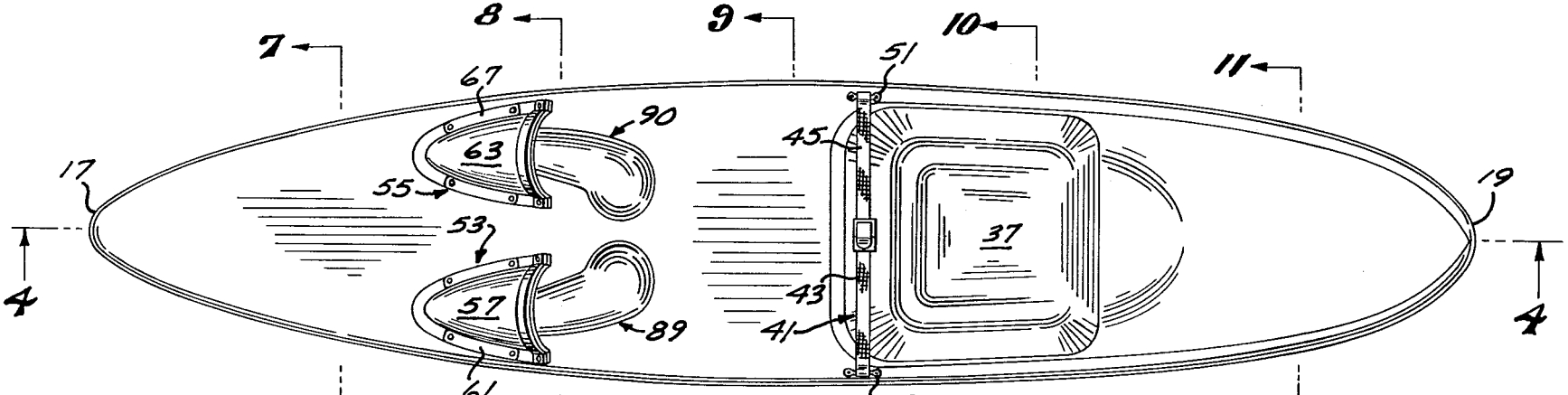
FIG. 2 is a top plan view of the surfboard shown in FIG. 1.
Figure 3:
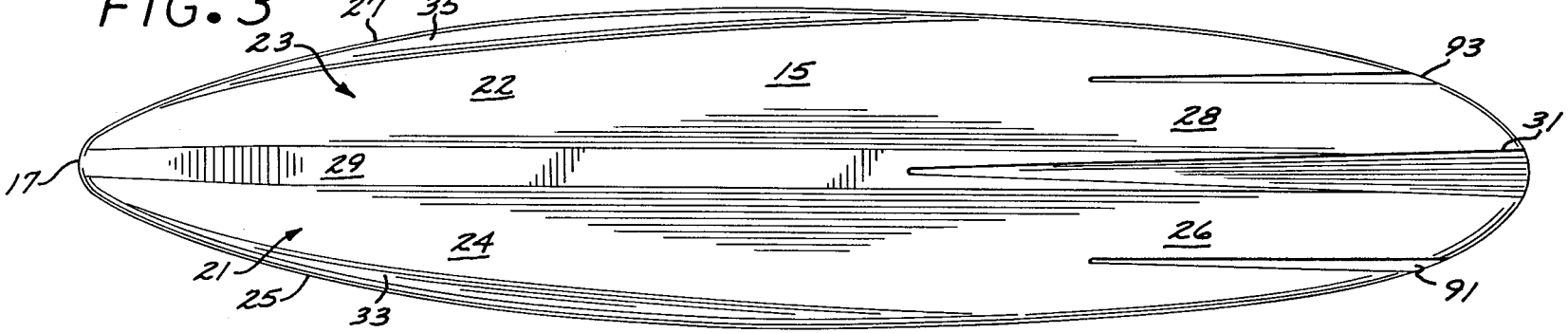
FIG. 3 is a bottom plan view of the surfboard shown in FIG. 1.

Referring to FIG. 2, the lap belt 41 includes left and right portions 43 and 45 made of elastic webbing or the like and an adjustable buckle 47 for securing the left and right portions across the lap of the rider. The buckle 47 may be of the type including a large lever style handle to be easily openable for a quick release. The left and right portions 43 and 45 have their opposite ends connected to the surfboard by brackets 49 and 51 or the like.

The footrest area 39 is defined, for example, by one or more cavities in the upper surface 13 of the board. In the preferred embodiment the footrest area comprises left and right heel indentations 73 and 75 each defined by a concavity in the upper surface 13 of the board and each adapted to support one of the rider's feet. The indentations 73 and 75 are somewhat V-shaped in transverse cross section to form upwardly and outwardly inclined opposite surfaces 77 and 79.

The indentations 73 and 75 angle, for example, forwardly and away from each other to accommodate the rider's feet in a toes-pointing-outwardly disposition. The heel indentations are lined with heal cups 89 and 90 of waterproof plastic, foam rubber or the like to cushion the rider's heels.

Referring to FIG. 2, toe covers, generally designated 53 and 55, in the form of flexible boots 57 and 63 are surmounted over the toe area of the cups 89 and 90. The boots 57 and 63 are received in U-shaped adjustment tracks 61 and 67 with the rear peripheries thereof being held in their distended open positions by respective hump shaped bands 59 and 65.

In operation the towable surfboard hull 11 may conveniently be mounted on the top of a car or on a trailer and towed to a launch site at the seashore, to be launched either from the beach or from a dock. The rider will position himself on the seat 37 with his feet received in the heel cups 89 and 90 with his toes received under the respective boots 57 and 63 (FIG. 2 . The belt 41 is then strapped across the rider's lap. The rider will then grasp the tow rope to be towed behind a power boat. It will be appreciated that, since the hull 11 has sufficient buoyancy to maintain the rider afloat, initial forward speed will cause the bow to rise upwardly in the water. As the speed of the board picks up, the bow will rise out of the water at a progressively increasing rate causing the fore portion of the hull to be carried generally on the flat ski 29 while the riding portions 22 and 24 afford a somewhat gradual entry into the oncoming water and waves. As the bow 17 continues to raise in the water, the point will be reached when the major weight of the vessel and rider is carried on the riding surfaces 26 and 28 representing the underside of the back one quarter of the overall hull length.

When the rider elects to turn the vessel, either to follow the turn of the towing boat or to traverse outside the wake of the tow boat, such turns may be achieved by merely leaning his body to the right or left relative to the longitudinal center line of the hull. For instance, if the rider leans to starboard as the hull is riding on the riding surfaces 26 and 28 (FIGS. 3, 10 and 11), the weight of the vessel will be shifted to the starboard riding surface 2 (FIGS. 10 and 11) causing the vessel to ride up on that surface. By such a maneuver, the drag of the vessel will be applied to the starboard surface 2 causing the hull to pivot somewhat causing the bow to be directed generally to starboard. Such direction of the bow will cause the water rushing rearwardly relative to the bottom of the hull to be directed through the central aft groove 31 thus tending to direct the vessel itself to the right. It will be appreciated that the convex bottom surface 28 and rounded relatively narrow stern 19 cooperate to facilitate a smooth turn.

As the rider leans further to the right, the bearing surface 93 of the starboard stabilizer will tend to carry a substantial portion of the hull weight thus tending to restrict further tipping to the right about the longitudinal center line. Concurrently, the starboard ledge 94 will track through the water giving the vessel even greater directional stability without undue tracking.

It will be appreciated that as the hull exits the wake of the tow boat and encounters the side wake or relatively rough seas, the bow 17 riding high in the water may be 2½ to 3 feet above the water surface. Thus, oncoming waves will be encountered by the underside of the fore portion of the vessel causing the modified deep-vee shape of the forward running portions 22 and 24 to plow through such waves tending to direct the water to the left and right, respectively. It will be appreciated by those skilled in the art that the flat ski 29 will provide for some tracking over the water while providing for greater slippage than would be the case for a sharp V. This feature is a important factor in controlling the vessel.

Oncoming air, water spray and foam will tend to be directed outwardly by the upwardly and outwardly inclined surfaces 22 and 24 (FIGS. 7 and 8) thus providing stabilizing forces to the outboard portions of the underside of the fore portion of the vessel, thus tending to restrict excessive tipping about the center line. The onrushing air and water will tend to be somewhat trapped within the outboard tunnels 33 and 35 thus enhancing the stabilizing force. Water and spray escaping outwardly from the tunnels 33 and 35 will be directed downwardly, forwardly and away from the rider by means of the respective starboard and port rails 25 and 27. It will be apparent that throughout the described maneuvering, the rider will cooperate in controlling the vessel by pressing on the left and right heel cups 89 and 90. Throughout the described starboard turn the vessel may encounter waves on the order of one or two feet in height allowing the entire hull to, from time to time, become totally airborne for short periods of time, following by water re-entry.

As the rider reaches the extreme of his starboard turn, a port maneuver may be initiated by merely shifting his weight to the port side of the center line, thus causing the port riding surface 2 to then become the weight bearing surfaces resulting in higher drag on the port rear portion of the vessel thus causing the bow to pivot to the left resulting in the directional groove 31 directing the vessel itself in a generally port direction. At this time the rider's torso may be angled rearwardly at an angle of about 30 degrees to the deck. The force on the tow rope may be countered by the rider pushing firmly on the inside arch side of the right foot cup 90 to facilitate a smooth firm turn. As described above, the bearing surface of the port stabilizer 91 will be driven into the water thus resisting excessive tipping to the port side and affording a gradual regular maneuver to port.

It has been demonstrated that with the towable surfboard of the present invention, waves may be jumped at relatively high speed permitting the board to jump as much as four feet into the air while affording a stable and gradual water re-entry even in relatively rough waters. In fact, the action of the subject modified deep-vee hull in rough water closely simulates the action of a conventional surfboard towed in calm water.

It is important that the arrangement of the seat 37 and heel cups 89 and 90 is such that when the rider is positioned on the board, the forwardly and upwardly inclined shape of the seat itself as viewed in FIG. 4 will tend to maintain the rider's torso inclined upwardly and rearwardly relative to the board itself. This feature is important in rough water, not only because the rider may push forwardly against the cushion by his posterior but because, recontact with the water after a jump or slamming into a wave at high speed sometimes results in considerable shock. The inclined position allows the shock to be taken by the rider's stomach muscles without direct axial application of forces of the spinal column.

From the foregoing it will be appreciated that a surfboard according to the invention provides a recreational vehicle affording many of the benefits of water skis but not requiring as great a level of physical exertion and skill. The surfboard can be towed at high speeds through rough water and can be turned and maneuvered safely and without upset, and the rider is shielded from excess spray.

Although one specific embodiment of the invention has been described and illustrated, the invention is not to be limited to the specific forms or arrangements of parts s described and illustrated, and various modifications and changes can be made without departing from the scope and spirit of the invention. Within the scope of the appended claims, therefore, the invention may be practiced otherwise than as specifically described and illustrated.

We claim:

1. A high performance towable modified deep vee surfboard for carrying a rider thereon for being towed by a tow rope having a handle and comprising:

a hull having sufficient buoyancy to support such a rider on a body of water, said hull having an upper surface defining a deck for carrying such rider and a bottom surface for contacting the water, the forward extremity of such hull defining a bow and the rearwardly extremity defining a stern;

a seat disposed rearwardly on said deck for supporting such rider in a sitting position;

laterally spaced apart heel cups mounted on said deck adjacent said bow and so disposed relative to said seat as to, when such rider is seated on said seat, receive the respective feet of such rider for pressing forwardly and outwardly thereon relative to such seat;

said bottom surface being formed at its forward portion with oppositely disposed downwardly facing port and starboard running areas inclined downwardly and inwardly at a predetermined angle relative to the horizontal to form a relatively deep vee running section;

a relatively narrow ski interposed between said running areas and projecting rearwardly from the bow to a location substantially midship; and said bottom surface extending rearwardly from said forward section to form a gradual transition into oppositely disposed downwardly facing port and starboard riding surfaces inclined, relative to the horizontal, at an angle less than said predetermined angle and extending rearwardly under said seat to the stern to form a relatively shallow vee riding section whereby a rider may sit inclined rearwardly on said seat with his feet received in said heel cups and grasp such rope handle directly in his hands such that towing forces applied to the rider will drive the surfboard forwardly over the water with said running section inclined upwardly and forwardly to cause said ski and running surfaces to slice into the water and oncoming waves while the majority of the weight of said rider is carried on said riding surface such that when the surfboard is maneuvered through a turn the relatively shallow vee shape of said riding section allows for relatively free lateral travel of said surfboard over the water surface.

2. A surfboard according to claim 1 and further comprising;

retaining means for retaining the rider on the surfboard.

3. A surfboard according to claim 2 wherein:

said retaining means comprises a lap belt connected to the surfboard on opposing sides of the seating area and adapted to cross closely over the rider's lap to retain the rider in the seating area.

4. A surfboard according to claim 1 and further comprising:

means for retaining the rider'feet in said heel cups.

5. A surfboard according to claim 4 wherein:

said means for retaining the rider's feet comprises a toeguard mounted on the surfboard adjacent said heel cups.

6. A surfboard according to claim 1 wherein:

said seat includes a concavity formed in said deck.

7. A surfboard according to claim 6 wherein:

said seat includes a cushion disposed in the concavity.

8. A surfboard according to claim 1 wherein:

said seat includes a cushion formed with an upwardly and forwardly projecting raised support surface.

9. A surfboard according to claim 1 wherein:

said deck is formed with concavities spaced athwart ship forward of said seat; and said heel cups are in the form of flexible cups received in said cavities.

10. A surfboard according to claim 1 wherein:

said deck includes left and right heel concavities formed in the upper surface of said deck and each adapted to support one of the rider's feet.

11. A surfboard according to claim 10 wherein:

said heel cups include elongated, flattened foot rest surfaces inclined inwardly and downwardly from outboard extremities of the upper surface of the surfboard member for supporting the rider's feet in spaced apart relation to each other whereby the rider's feet can be braced against the foot rest surfaces when the rider and board are being towed.

12. A surfboard according to claim 11 wherein:

said heel cups project rearwardly toward each other to accommodate the rider's feet in a toes-pointing-outwardly disposition.

13. A surfboard according to claim 10 and further comprising:

left and right toeguards mounted on the surfboard adjacent the left and right heel cups for retaining the rider's left and right feet, respectively, in said heel cups.

14. A surfboard according to claim 1 wherein:

said bottom of said board curves upwardly and outwardly in opposite directions near the bow whereby the bow tends to ride above the water when the board is being towed.

15. A surfboard according to claim 1 wherein:

said bottom includes a plurality of rearwardly projecting stabilizer areas, each such area having a concave cross section defining a downwardly opening stabilizer groove.

16. A surfboard according to claim 1 wherein:

said running areas are formed in the fore portion of said hull to incline downwardly and inwardly toward one another at an angle of substantially 20 degrees to the horizontal.

17. A towable surfboard as set forth in claim 1 wherein:

said bottom surface includes a downwardly opening steering groove formed between said port and starboard riding surfaces and opening rearwardly at said stern.

18. A towable surfboard as set forth in claim 1 wherein:

said riding surfaces project forwardly toward midship and are formed adjacent midship to curve downwardly and inwardly to form respective convex surfaces.

19. A towable surfboard as set forth in claim 1 wherein:

said riding surface angles laterally downwardly and inwardly at an angle of substantially 11° to the longitudinal.

20. A towable surfboard as set forth in claim 1 wherein:

said running areas angle laterally downwardly and inwardly at an angle of substantially 20° to the horizontal; and said ski is formed with a flat bottom surface.

21. A towable surfboard as set forth in claim 1 that includes:

rearwardly projecting stabilizer wings flanking said riding surfaces and formed with a respective downwardly facing bearing surfaces,.

22. A towable surfboard as set forth in claim 21 that includes:

rearwardly projecting, inwardly and upwardly angled control ledges formed on the inside edge of said stabilizing wings.

* * * * *